US007328694B2

(12) United States Patent
Edmonds

(10) Patent No.: US 7,328,694 B2
(45) Date of Patent: Feb. 12, 2008

(54) ARCHERY BOWSTRING RELEASE

(76) Inventor: Robert Joe Edmonds, 4781 Yellow Banks Rd., Mulkeytown, IL (US) 62865

( * ) Notice: Subject to any disclaimer, the term of this patent is extended or adjusted under 35 U.S.C. 154(b) by 0 days.

(21) Appl. No.: 11/213,400

(22) Filed: Aug. 29, 2005

(65) Prior Publication Data

US 2007/0044783 A1 Mar. 1, 2007

(51) Int. Cl.
*F41B 5/18* (2006.01)

(52) U.S. Cl. ..... 124/35.2

(58) Field of Classification Search ..... 124/35.2
See application file for complete search history.

(56) References Cited

U.S. PATENT DOCUMENTS 4,062,339 A * 12/1977 Wilson ..... 124/35.2
4,173,210 A * 11/1979 Napier ..... 124/35.2
4,316,443 A * 2/1982 Giacomo ..... 124/35.2

* cited by examiner

*Primary Examiner*—John A. Ricci
(74) *Attorney, Agent, or Firm*—Peter R. Bahn

(57) ABSTRACT

Disclosed is an archery bowstring release that increases the power and length of the draw by having the pincer of the release being recessed a few inches behind the trigger of the release in relation to the bowstring. The present release achieves this result by having a long trigger column rigidly joined to a short pincer column at an acute angle of 20 degrees. A standard type wrist strap is preferably always used in the operation of this release.

12 Claims, 6 Drawing Sheets

ARCHERY BOWSTRING RELEASE

BACKGROUND OF THE INVENTION

This invention falls into the general category of being a tool for archery and into the specific category of being a tool for the precision mechanical release of archery bowstrings.

In traditional archery, an archer will grip his bow by a handle midway along the spine of a bow and hold the bow at full arm's length with one arm. With an arrow in position and notched on the bowstring, the archer will pull the bowstring back with the other arm as far as he is able to pull it while holding on to the taught bowstring with three fingers while aiming the bow and then releasing the bowstring with the said three fingers. This is ancient art in the field of archery.

However, in the field of modern archery, there have been developed several devices to improve various aspects of this field's practice. Perhaps the largest development has been the invention of the compound bow. However, another significant development has been the invention of the mechanical bowstring release. The mechanical bowstring release assures a smooth and precision release of the bowstring that is impossible to match with the use of human fingers.

The typical bowstring release in the prior art is comprised of a single column of cylindrical or rectangular cross section that contains one or two jaws for holding a bowstring taught when the jaw or jaws are closed and also a trigger for opening the jaws to release the bowstring. The release will sometimes also possess a solid attached handle to be grasped by the archer's palm and fingers, the said handle being attached collinearly or perpendicularly to the column. More often, however, the single column bowstring release will have an attached flexible wrist strap that that the archer has around his wrist as he grips the single column body of the release. A typical archery bowstring release and attached wrist strap are shown, for example, in U.S. Pat. No. 5,595,167 to Scott.

The problem with all prior art bowstring releases is that the release trigger is always situated behind the release jaw or jaws. This fact means that the final position of the bowstring right before release will always be a bit less than the position of the archer's fingers in terms of the draw length of the drawn bow.

It would be advantageous to possess a bowstring release in which the release jaws are behind the release trigger because that much distance would be added to the bowstring draw for the same position of the archer's hand instead of subtracted from the bowstring draw that occurs when the release jaws are in front of the release trigger. This is so for two reasons. The longer the draw is, the more force there will be behind the shot of the arrow. Also, the arm drawing the bowstring has more muscle power in the middle part of the draw when the drawing hand is in front of the archer's chest than when the drawing hand is at the end of the draw when the drawing hand is at the side of the archer's chest.

The problem in designing a bowstring release in which the jaws are behind the release trigger is how to place the jaws in relation to the trigger so that the released bowstring will not hit the trigger or the archer's fingers.

BRIEF SUMMARY OF THE INVENTION

The archery bowstring release presented here is essentially comprised of a long trigger column rigidly fixed to a short pincer column at an acute angle (that is, an angle less than 90 degrees). This configuration of the release results in the pincer jaws being a few inches behind the trigger in relation to the bowstring. Normally, the jaws of the pincer are closed. However, when the trigger is pressed, a rod in the trigger column is depressed which rod then depresses a plate-rod in the pincer column, such second rod moving away from the pincer feet so as to allow a spring to open the jaws of the pincer. This archery bowstring release is used with a wrist strap to help the archer's hand to grip the trigger column of the release.

BRIEF DESCRIPTION OF THE DRAWINGS

The archery bowstring release of the present invention is shown in the accompanying drawings.

FIG. 2 is the view that is obtained if FIG. 1 is rotated ninety degrees into its page.

FIG. 5 shows the long rod that goes inside the trigger column and also shows a side view and a top view of the trigger column, along with the trigger. FIG. 6 shows a top view and a side view of one pincer, along with the spring, ball bearing, and roller wheel that go inside it. FIG. 6 also shows a side view and a top view of the short pincer column, along with the rod-in-plate and the spring that go inside it.

DETAILED DESCRIPTION OF THE INVENTION

Figure 1:
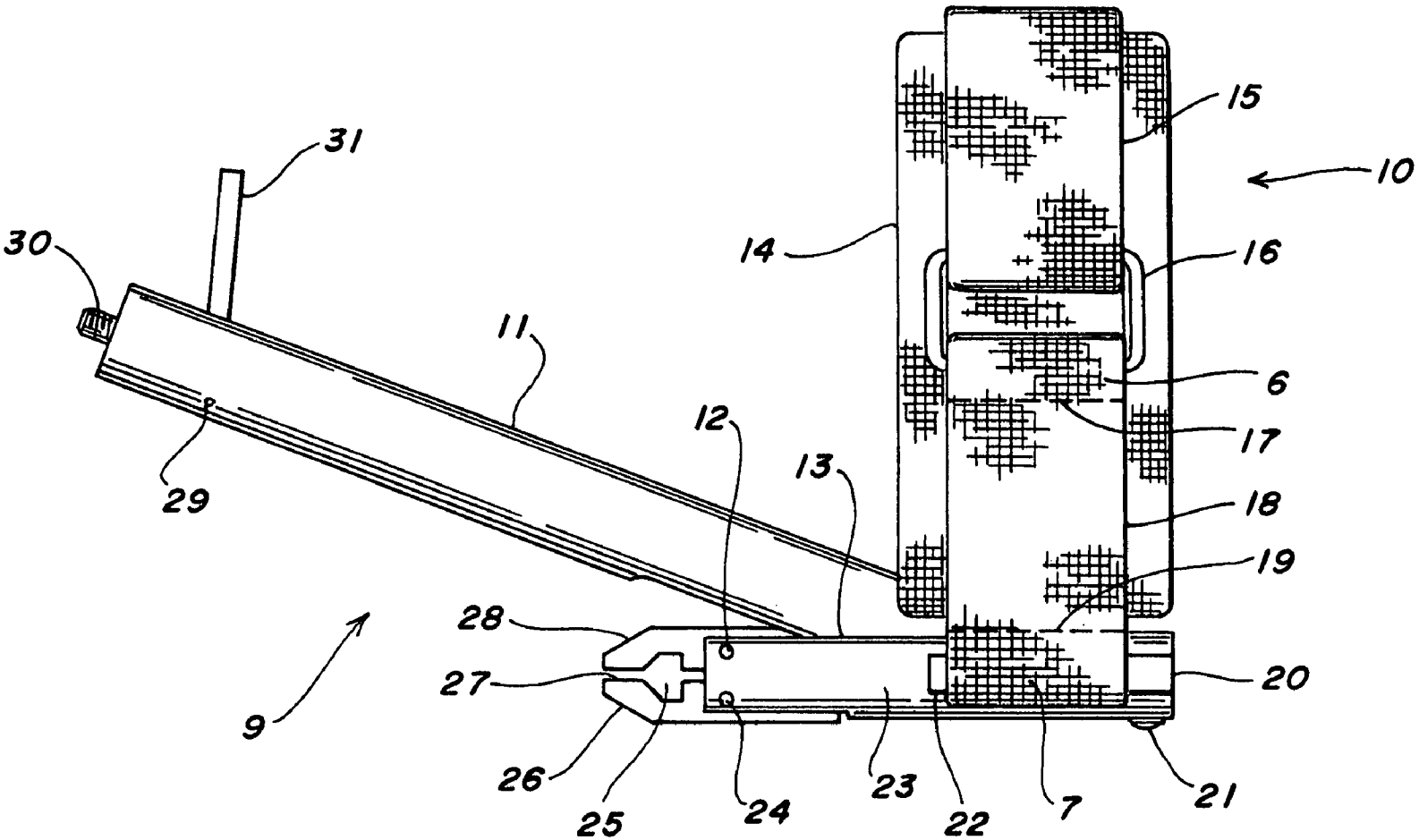
FIG. 1 shows a top view of the release along with a standard type wrist band attached to it. This view is looking down from the top of the bowstring toward the bottom of the bowstring as if the bowstring is running into the page of the figure.
Figure 2:
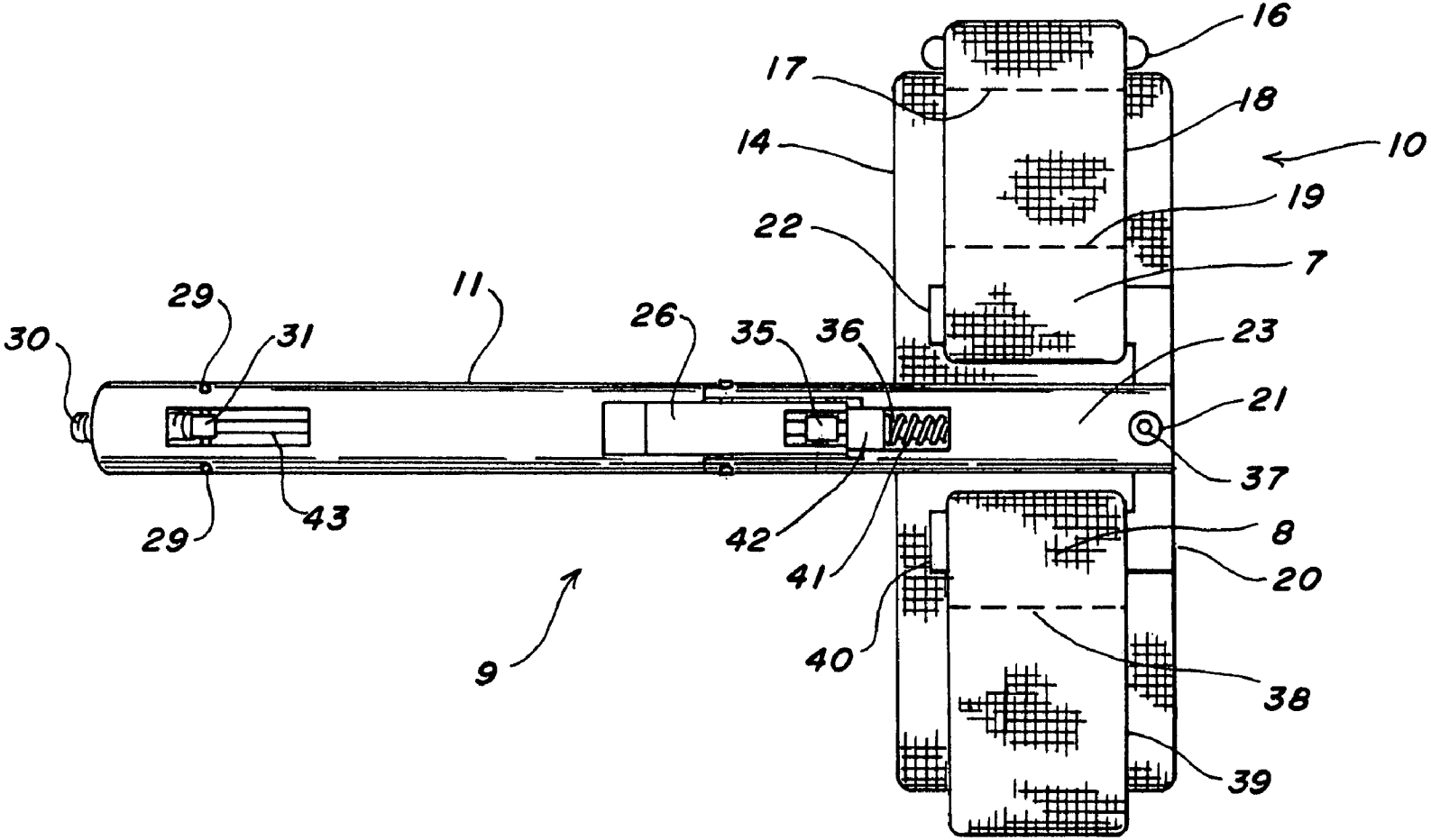
FIG. 2 shows a side view of the release/wrist band assembly, as if the bowstring is running from the top of the page to the bottom of the page.
Figure 3:
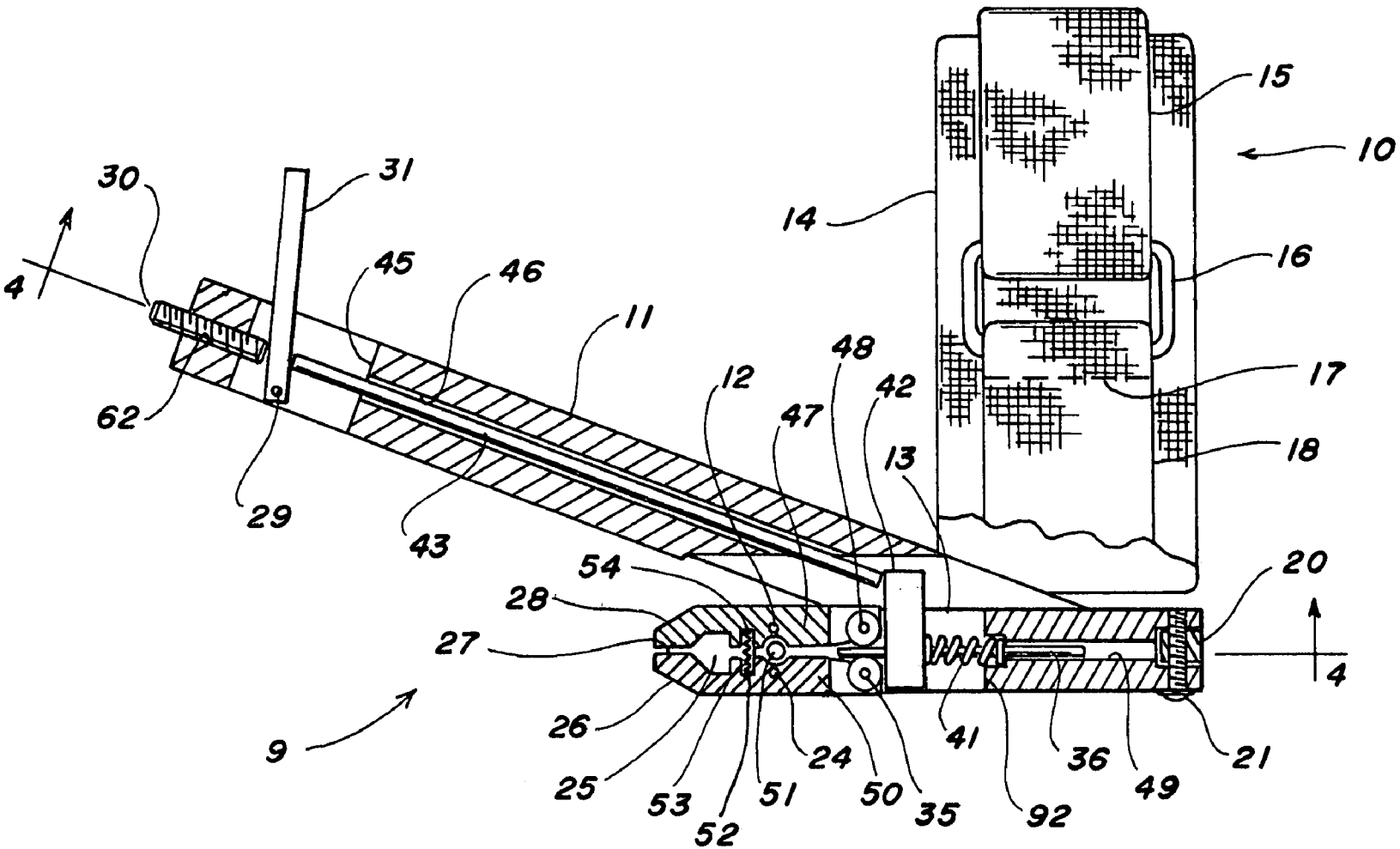
FIG. 3 is a cross section view of FIG. 1, that is, a top view of the release and wrist band.
Figure 4:
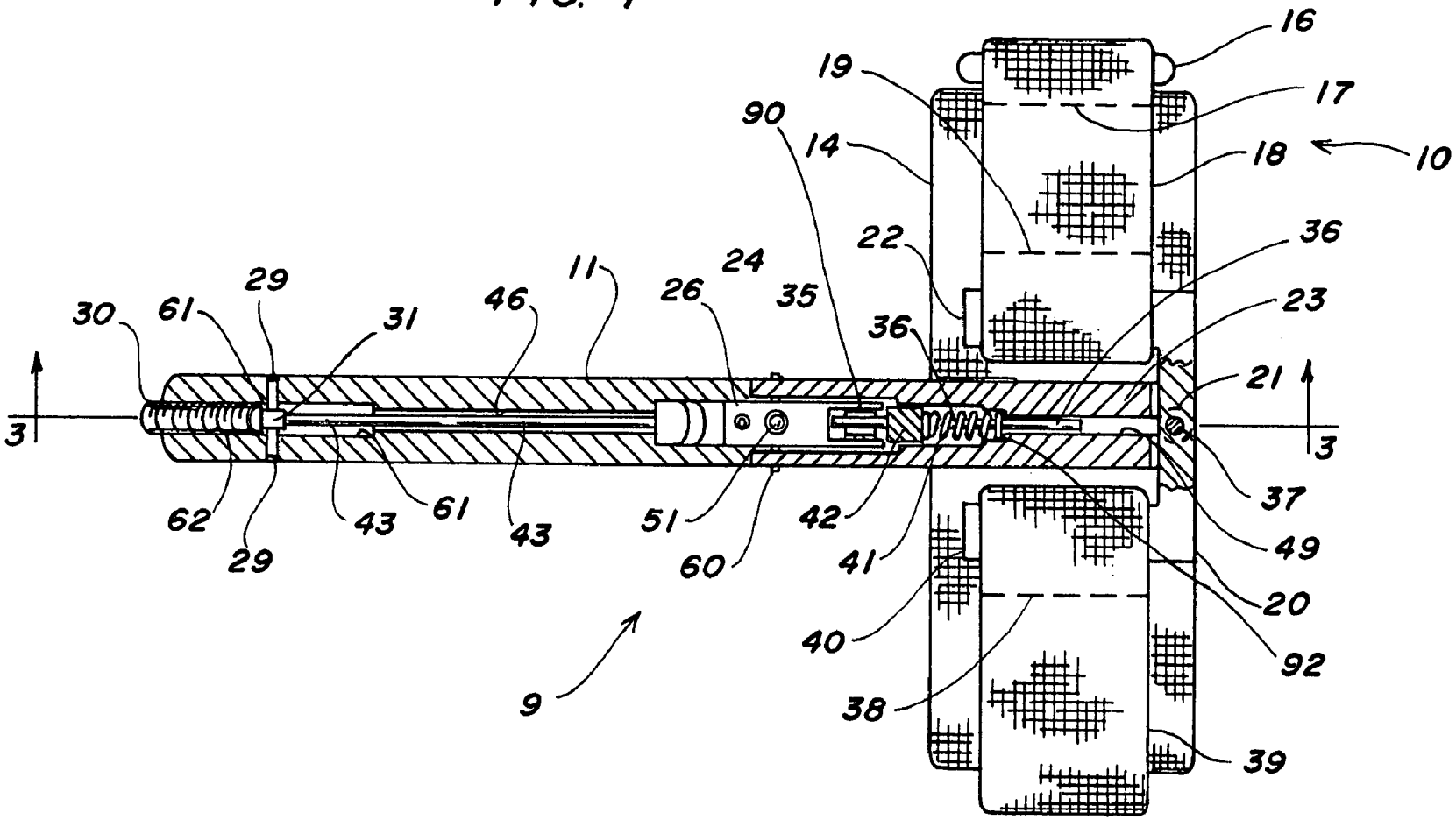
FIG. 4 is a cross section view of FIG. 2, that is, a side view of the release and wrist band.
Figure 5:
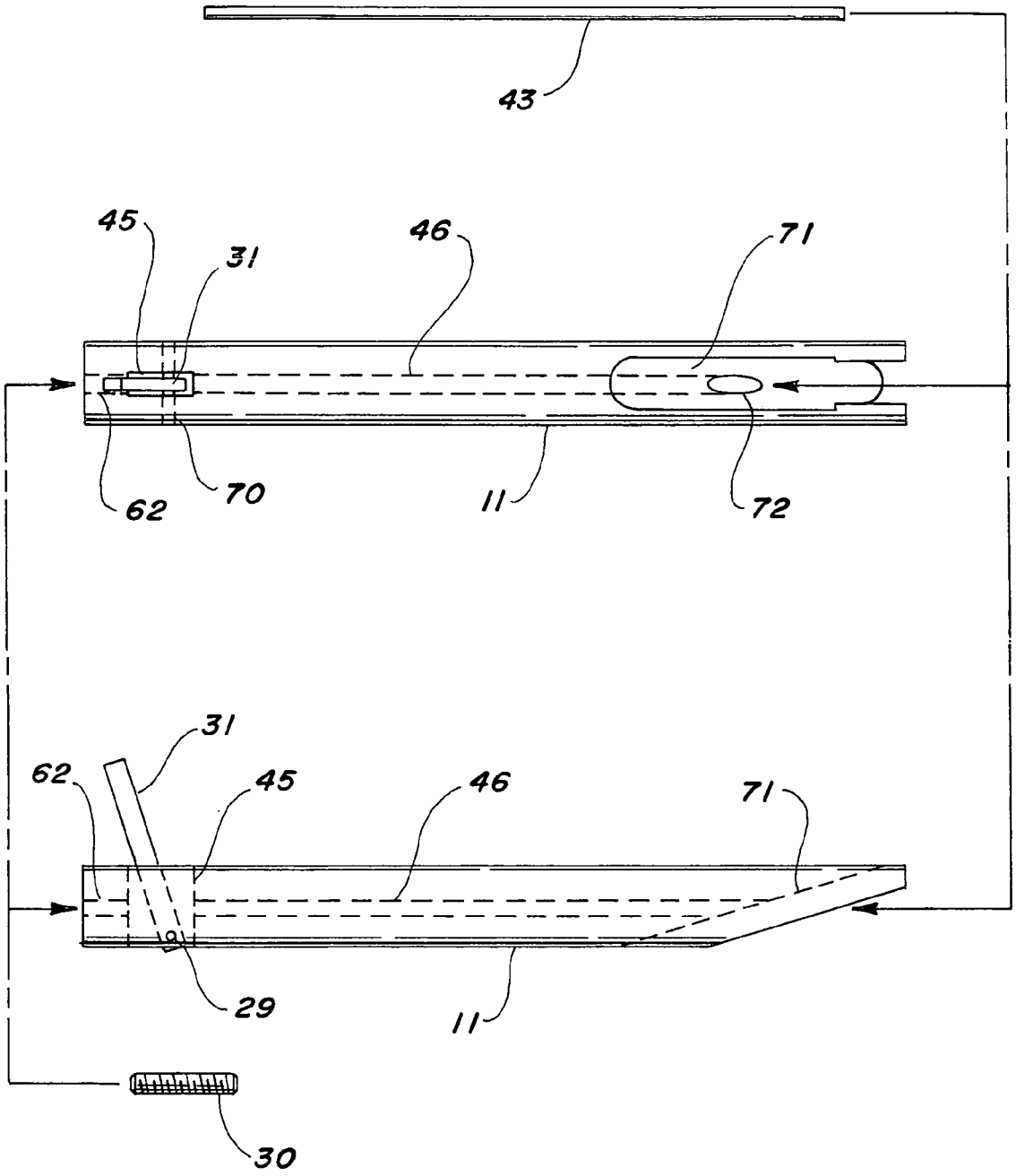
FIG. 5 and FIG. 6 are views of the disassembled parts of the bowstring release and how they are assembled to make the release.
Figure 6:
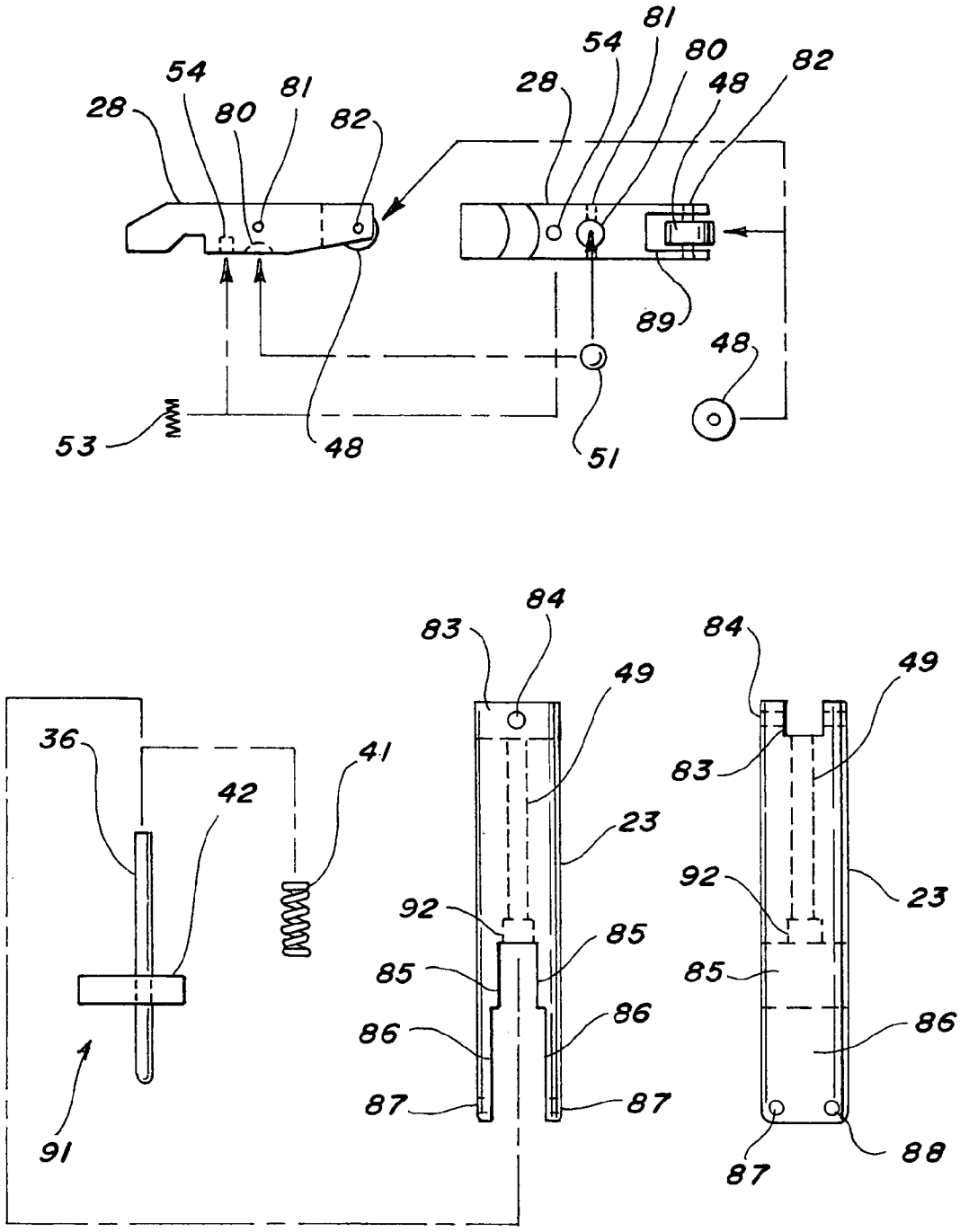

Looking at FIGS. 1-6 simultaneously, it is seen that this archery bowstring release 9 is comprised of a long trigger column 11 rigidly fixed to a short pincer column 23 at an acute angle, that is, an angle less than ninety degrees. The column 11 and the column 23 are rigidly fixed together by welding at the seam 13 between the two columns. The inventor has found that in the best mode of this invention, the angle between the two columns is 20 degrees. The two columns 11 and 23 can be columns of rectangular cross section or columns of oval or round cross section. The inventor has found that columns of round cross section, that is, cylindrical columns are the preferred mode of construction of this invention although the inventor has also constructed this invention using square cross section columns. The bowstring release 9 is preferably made of all metal parts.

Running through the axis of the long column 11 is a hole 46. Inside this hole 46 fits a movable rod 43. Also in the column 11 is a slot 45 in which the trigger 31 is held by pinion 29 fitting tightly into a thin hole 70 in the column 11. The pivot angle of the trigger 31 within the slot 45 of the column is lessoned by an adjustable threaded bolt 30 which screws into a threaded hole 62 of the column 11.

The short pincer column 23 holds two pincers 28 and 26. These two pincers are held in a slot 86 in the column 23 by two rods 12 and 24 that extend through two holes 87 and 88 in the slot 86 in the column 23. The two pincers 26 and 28 can pivot about the two rods 24 and 12. In addition the two pincers 28 and 26 also pivot about a ball bearing 51 which sits within two hemispheric holes 80 and 90, one each in each pincer. Each pincer foot 47 and 50 has slot (see slot 89) that holds a roller wheel 48 and 35 that is held in the pincer foot 47 and 50 by an axle 82 and 90, respectively. Each pincer 28 and 26 also has a hole 54 and 52 into both of which fits a small spring 53, that normally pushes against the jaws of the pincers so as to open them if the pincers are not otherwise restrained.

However, the pincers 28 and 26 are so restrained from opening by a rod 36 which is pressed up between the feet 47 and 50 of the pincers. This rod 36 passes between the two roller balls 48 and 35 and on through a rectangular plate 42 to which such rod 36 is rigidly attached and which can be referred to as a rod-in-plate 91. The rod-in-plate 91 is normally kept pressed against the feet 47 and 50 of the pincers by a large spring 41 through which extends the rod 36 and which spring sits in a slot 85 in the short column 23 and a short well 92. Running along the axis of column 23 is a hole 49 in which the rod 36 movers back and forth when the trigger 31 in the long column is pressed. This trigger 31 presses down the rod 43 which presses backward the plate 42 which moves back the rod 36 from the feet 47 and 50 of the pincers 28 and 26 which pincers then pivot so as to open their jaws which then release the bowstring from the space 25 between the jaws of the pincers. Thus, when no pressure is exerted on the trigger 31 the pincers 28 and 26 stay closed, but when the trigger 31 is pressed back, the pincers 28 and 26 stay open.

The present inventor always uses this release 9 is with a wrist strap 10. For the purpose of attaching the wrist strap 10 to the release 9, the short column 23 has a slot 83 in which a squared off U shaped beam 20 is placed and secured to the column 23 with a hex bolt 21 which has a hex well 37. The wrist strap 10 has two loops 7 and 8 made by the sewing seams 19 and 38 respectively. The two arms 22 and 40 of the U beam 20 are placed respectively into the loops 7 and 8 to attach the wrist strap 10 to the release 9. The strap 18 of the wrist strap 10 has loop 6 made by the sewing seam 17 through which is attached a loop ring 16. Through the other side of the loop ring 16 is placed a Velcro "hook" strap 15 which adheres to a "loop" strap on the other side of the wrist strap 10. The wrist strap can be tightened or loosened by adjusting the length of "hook" strap 15 that is pulled through loop ring 16. The wrist strap also has an extra inner layer of strap 14 for cushioning on the wrist during operation of the combination release 9 and wrist strap 10. There are a number of ways of attaching a wrist strap to an archery bowstring release which are well known in the art. The method of attachment explained above is simply one example preferred by the inventor.

The combination release 9 and wrist strap 10 are operated by the archer placing his hand through the wrist strap 10, placing the release 9 on the back of his hand between his thumb and index finger, or on the palm side of his hand, and adjusting it for preferred tightness The archer then places his index finger of that hand on the trigger 31 and presses the trigger backward toward his wrist. The pincer jaws open. The bowstring or its release loop is then placed in the space 25 between the jaws. The trigger 31 is then releases closing the pincer jaws around the bowstring or its notch loop. The bowstring is then drawn back by the archer. The archer aims his bow at the target. Then the archer presses the trigger backward. The pincer jaws open up, and the released bowstring quickly propels the arrow to its target.

What is claimed is:

1. An archery bowstring release comprised of a long trigger column rigidly joined to a short pincer column at an acute angle such that pressing a trigger causes the backward movement of a rod in the long column which causes the backward movement of a rod in the short column which causes a jaw or jaws of a pincer to open.

2. An archery bowstring release as described in claim 1 wherein the parts of the release are made of metal.

3. An archery bowstring release as described in claim 2 wherein the long column and the short column are cylindrical.

4. An archery bowstring release as described in claim 1 wherein the long column and the short column are cylindrical.

5. An archery bowstring release comprised of a long trigger column rigidly joined to a short pincer column at an acute angle such that pressing a trigger causes the backward movement of a rod in the long column which causes the backward movement of a plate containing a rigidly fixed rod which causes the backward movement of the rigidly fixed rod in the short column which backward movement of the rod in the short column away from a foot or feet of a pincer causes a jaw or jaws of the pincer to open.

6. An archery bowstring release as described in claim 5 wherein the trigger, rod in the long column, and plate with rigidly fixed rod, are normally kept in a forward position by the pressure of a large spring in the short column behind the said plate, and wherein the said jaw or jaws of the said pincer are caused to open by a small spring pushing the said jaw or jaws apart when the said rod in the said plate is moved back from the foot or feet of the said pincer.

7. An archery bowstring release as described in claim 6 wherein the parts of the release are made of metal.

8. An archery bowstring release as described in claim 7 wherein the long column and the short column are cylindrical.

9. An archery bowstring release as described in claim 6 wherein the long column and the short column are cylindrical.

10. An archery bowstring release as described in claim 5 wherein the long column and the short column are cylindrical.

11. An archery bowstring release as described in claim 5 wherein the parts of the release are made of metal.

12. An archery bowstring release as described in claim 11 wherein the long column and the short column are cylindrical.

* * * * *